US005665943A

United States Patent [19]

D'Antonio

[11] Patent Number: 5,665,943

[45] Date of Patent: Sep. 9, 1997

[54] NESTABLE SOUND ABSORBING FOAM WITH REDUCED AREA OF ATTACHMENT

[75] Inventor: Peter D'Antonio, Upper Marlboro, Md.

[73] Assignee: RPG Diffusor Systems, Inc., Upper Marlboro, Md.

[21] Appl. No.: 490,898

[22] Filed: Jun. 15, 1995

[51] Int. Cl.[6] ..... E04B 1/82

[52] U.S. Cl. ..... 181/295; 181/294; 181/286

[58] Field of Search ..... 181/284, 286, 181/288, 290, 293, 294, 295

[56] References Cited

U.S. PATENT DOCUMENTS

| | | | |
|---|---|---|---|
| 2,390,262 | 12/1945 | Mazer | 181/286 |
| 2,779,429 | 1/1957 | Mazer | 181/286 |
| 3,035,657 | 5/1962 | Lemon | 181/290 |
| 3,182,747 | 5/1965 | Wilhelmi et al. | 181/286 |
| 4,242,398 | 12/1980 | Segawa et al. | 181/290 X |
| 4,425,981 | 1/1984 | Kiesewetter et al. | 181/286 |
| 4,531,609 | 7/1985 | Wolf et al. | 181/290 |
| 4,805,724 | 2/1989 | Stoll et al. | 181/290 |

*Primary Examiner*—Khanh Dang
*Attorney, Agent, or Firm*—H Jay Spiegel

[57] ABSTRACT

Numerous embodiments of a nestable sound absorbing foam each including a reduced area of attachment to an adjacent wall surface and a variable depth air cavity to enhance absorption. The embodiments include various configurations of "one-dimensional" sine waves, saw tooth cross-sections, triangular and crown shaped cross-sections as well as square wave cross-sections and part cylindrical cross-sections. In addition, two-dimensional nested topologies with a variable depth air cavity are also described. In each embodiment, the major portion of the rear surface of the material which is to be attached to a wall surface is spaced as far as possible from the wall surface creating a variable depth air cavity to enhance sound absorption. When the rear air cavity is sealed, additional low frequency absorption is achieved by increased air flows through the foam material caused by the pressure gradient in the low frequency pressure zone.

18 Claims, 15 Drawing Sheets

NESTABLE SOUND ABSORBING FOAM WITH REDUCED AREA OF ATTACHMENT

BACKGROUND OF THE INVENTION

The sound that we hear in a room is a complex combination of the direct sound and the sound indirectly scattered from the room's contents and boundary surfaces. The indirect reflections can be manipulated by reflection, diffusion and absorption. Various porous materials have been used to provide sound absorption, such as fiberglass batting, various woven and non-woven cloths, rugs, etc. One of the most widely used materials for the purpose of sound absorption has been plastic foams. Plastic foams manufactured from various resins such as polyester urethane and polyether urethane have existed for almost fifty years and they have been used widely for sound absorption for at least the latter half of that period. These urethane foams do not meet the Class A Life Safety Code 6-5.3.2 for an interior wall and ceiling finish. Typically urethane foams are a Class C material with a flame spread between 76–200 and a smoke developed of 0–450.

Class A includes any material classified at 25 or less on the flame spread test scale and 450 or less on the smoke test scale described in National Fire Protection Association standard 255 or ASTM E-84. Newer foams such as melamine and polyimide have begun to find their way into the acoustical absorption market and do meet the requirements of Class A. However, melamine and polyimide are much more expensive than polyurethane. Polyurethanes are relatively low cost materials, costing approximately $0.70/lb. Melamine, although not much more in cost than polyurethane, usually under $1.00/lb., has proven difficult and costly to obtain in a foamed state. As a foamed product, melamine is almost twice the price of a comparable polyurethane product of similar design and configuration. Polyimide at $18.00/lb. and other newer foams have the severely limiting factor of high cost. This has left the polyurethane and melamine foams to fill most acoustical absorption processing needs.

Traditional foam absorption products consist of a flat rear surface which is glued to a reflecting room boundary and a front surface which usually has some unique design formed by a computer numerically controlled (CNC) cutter or a convoluting apparatus. The active surface is designed to both increase the total surface area for greater potential absorption as well as to create some aesthetic value. This essential design, with a large flat surface directly adhered to the reflective room boundary has been one design aspect which has been included in all of the acoustical tiles on the market. Applicant has found that for optimum material utilization and sound absorption, a porous sound absorbing material should not be placed directly on a reflective surface.

A porous material absorbs sound by converting sound energy into heat by friction of the vibrating air particles within the fine pores of the material. For this process to be effective, there must be freedom for the air particles to move. The higher the particle velocity, the better the sound absorbing capability. As the particle velocity is decreased, energy conversion is less efficient and less sound energy is absorbed. At a hard wall surface, the particle velocity is zero, hence there is very little absorption. Thus, any sound absorptive material placed against a hard wall is virtually useless because there can be no air motion within and behind the material to dissipate the sound energy.

Nevertheless, it is common practice to mount sound absorptive layers directly against a wall because it is very convenient to do so. Applicant has discovered that, in such cases, only a fraction of the outer layer is effective in absorbing sound below 1000 Hz. The rest of the material is simply acting as a convenient support. Since the price of melamine, polyimide and other future fire-safe foams is significant, it is important to fully utilize as much of the volume of the foam material for absorption as is possible.

It is with these problems encountered with foam absorbing materials as used in the prior art that the present invention was developed.

SUMMARY OF THE INVENTION

The present invention relates to a nestable sound absorbing foam with reduced area of attachment. The present invention includes the following interrelated objects, aspects and features:

(A) The present invention is described herein in terms of numerous embodiments thereof, all of which have a common thread. This common thread involves maximizing the sound absorptive capabilities of the material employed while, at the same time, minimizing the volume of material which must be employed for this purpose.

(B) In each embodiment of the present invention, the material which is employed has a rear surface which minimizes the surface area of direct attachment to a flat wall or surface to which the material is attached. Additionally, preferably, the portions of the rear surface that are spaced from the wall are spaced as far as possible therefrom to create a maximized variable depth rear air cavity volume. Optimally, the surface area engaging the wall should not exceed 10% of the area of coverage of a panel over a wall. In this way, a substantial volume of the foam material is located away from the wall. Thus, the foam material is more effective in providing enhanced sound absorption, since the foam material is located where the particle velocity is greater than zero.

(C) At the same time, the forward surface of each embodiment has an enlarged surface area with respect to the length, width and volume of the material to enhance the surface area of, for example, porous foam facing the incident sound waves to thereby enhance sound absorbing capability.

(D) Furthermore, the surface configurations of the forward and rearward surfaces of the material which is employed are preferably designed to allow nesting of plural layers of the material, both to facilitate addition of additional layers of sound absorbing material and to reduce the volume of space necessary for shipment and storage of the material.

(E) Test results, discussed hereinbelow, reveal that the present invention enhances the noise reduction coefficient of the materials which are employed, over and above the noise reduction coefficient for materials employed in prior art shapes and configurations by at least 15%, and in some configurations, to as much as 50%.

(F) In the preferred embodiments of the present invention, the material which is employed consists of a material known as "melamine", a flexible open cell foam produced from melamine resin, a thermo set of the amino-plastics group. The three dimensional skeletal structure of the foam is made up of deformable open pores. The density of this material may range from 0.6 lbs./ft.$^3$ (3 kg./m3) to 1.6 lb./ft.$^3$ (8.5 kg./m$^3$). By comparison, polyimide foam has a nominal density of 1 lb./ft.$^3$ (5 kg./m$^3$). Melamine foam meets all ASTM E-84 Fire Test Requirements with a "flame spread" of 10 and a "smoke developed" of 50. National Life Safety codes require Class A materials to have a "flame spread" of less than 25 and a "smoke developed" of less than 400.

Accordingly, it is a first object of the present invention to provide a nestable sound absorbing foam with reduced area of attachment and maximized variable depth rear air cavity volume.

It is a further object of the present invention to provide such a device in numerous embodiments each of which includes a reduced surface area of attachment and maximized variable depth rear air cavity volume.

It is a yet further object of the present invention to provide such a device in numerous embodiments including nesting capability for reduced storage and transport requirements as well as to provide the ability to add layers of sound absorbing foam to existing layers thereof.

It is a still further object of the present invention to make such a device out of a sound absorbing foam such as foamed melamine.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
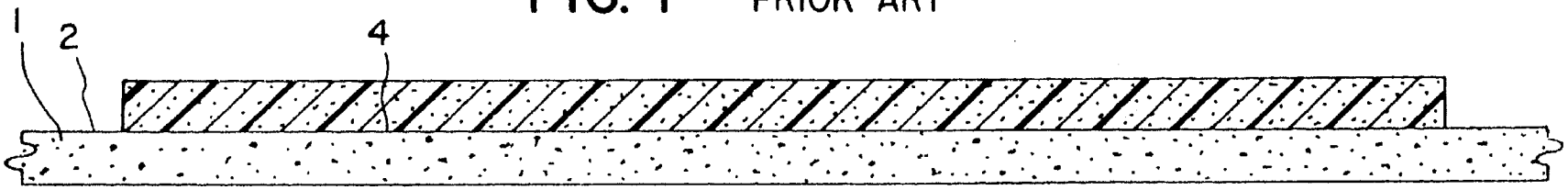
FIG. 1 PRIOR ART
FIG. 1 shows a cross-sectional view of a prior art sound absorbing panel as mounted on a flat wall surface.

With reference, first, to FIG. 1, a cross-section through a wall 1 reveals that the wall 1 has a flat outer surface 2. A rectangular cubic piece of foam 3 has a rear flat surface 4 which engages the surface 2 of the wall 1 when the piece of foam 3 comprising a panel is mounted thereon. As should be understood from FIG. 1, in the prior art, the rear surface 4 of the panel 3 has an area of engagement with the surface 2 of the wall 1 which encompasses the entirety of the rear surface 4 of the foam panel 3.

Figure 2A:
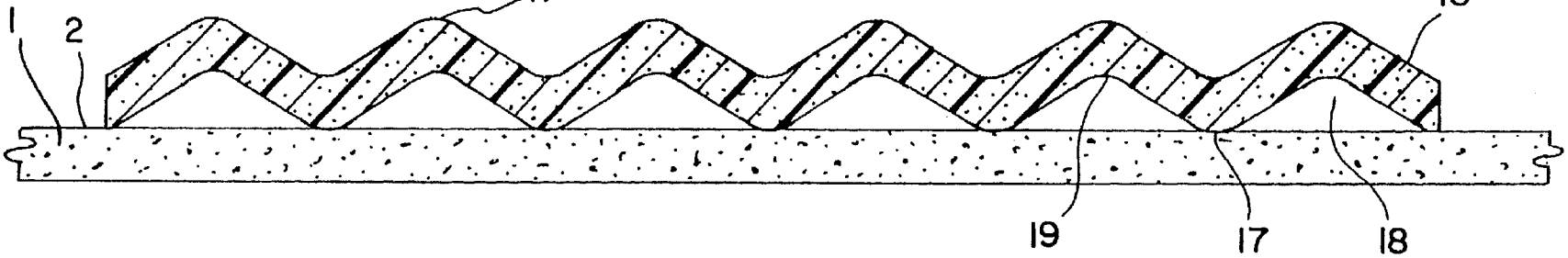
FIG. 2*a* shows a cross-sectional view showing the generally sine wave configuration of a first embodiment of panel made in accordance with the teachings of the present invention.

With reference, now, to FIG. 2*a*, the wall 1 still has the flat surface 2. However, in a first embodiment of the present invention, it is seen that the panel 11 has a rear surface 13 which resembles a "sine wave" and a front surface 15 which mimics the sine wave configuration of the rear surface 13. As shown, the apices 17 of the sine wave of the rear surface 13 of the foam panel 11 engage the surface 2 of the wall 1 at discrete spaced lines which extend into the paper in the view of FIG. 2*a* and which define, therebetween, air chambers 18 which permit air particles to flow while maintaining substantial velocity.

Figure 5:
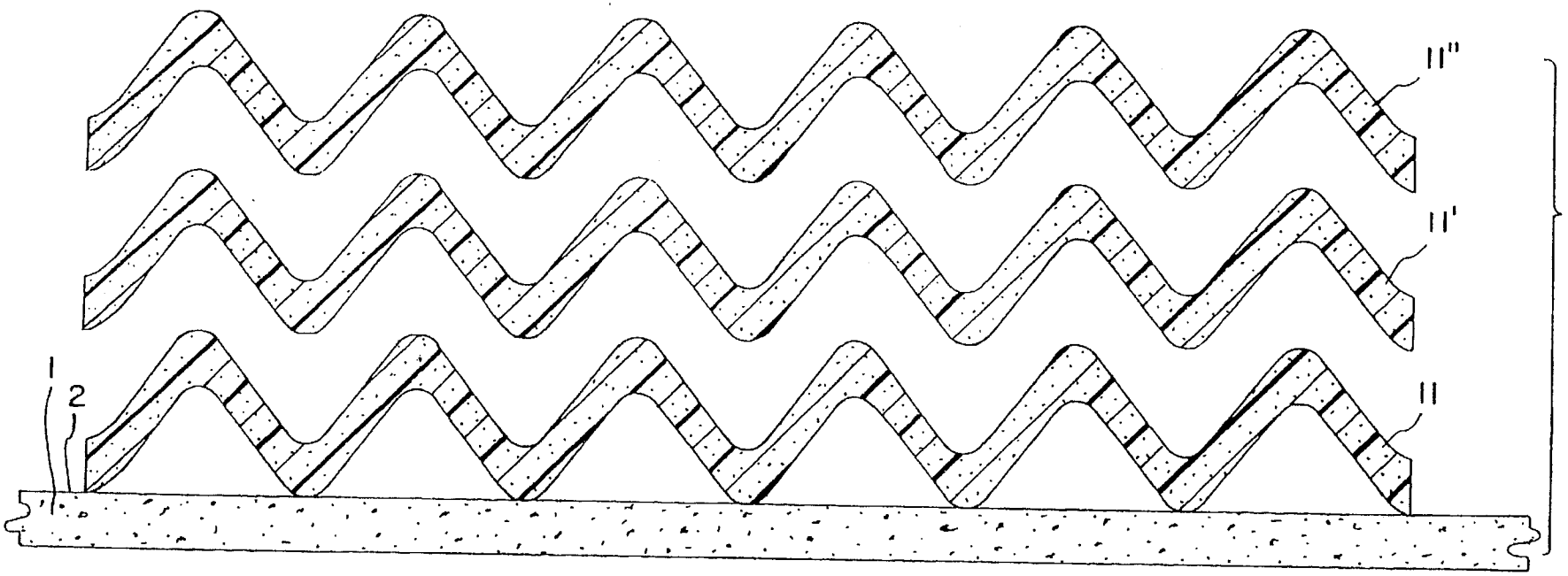
FIG. 5 shows a cross-sectional view showing a configuration such as the sine wave configuration of FIG. 2*a* with a plurality of nesting panels shown in exploded configuration.

The fact that the surfaces 13 and 15 mimic one another facilitates stacking of a plurality of layers of panels such as the panel 11. In this regard, attention is directed to FIG. 5 which shows the wall 1 with the surface 2 and the panel 11 mounted on the surface 2 in the manner shown in FIG. 2*a*. Additional panels 11' and 11" are shown in exploded cross-sectional view and are intended to nest with one another and with the panel 11 to triple the thickness of the sound absorbing panel which is made through nesting of the panels 11, 11' and 11". When such panels are so nested, they are adhered together by providing adhesive placed at small, greatly spaced, discrete locations thereon since adhesive blocks flow of air particles.

Figure 2B:
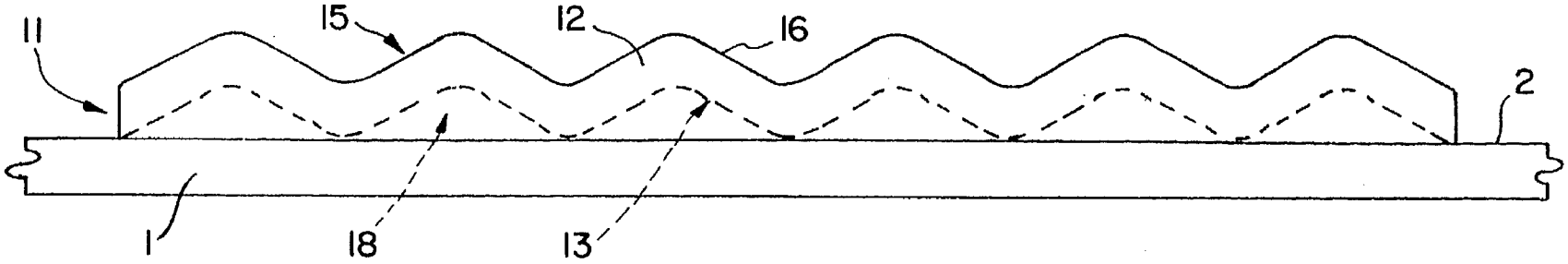
FIG. 2*b* shows a top view of the panel embodiment of FIG. 2*a* as mounted on a wall.
Figure 3:
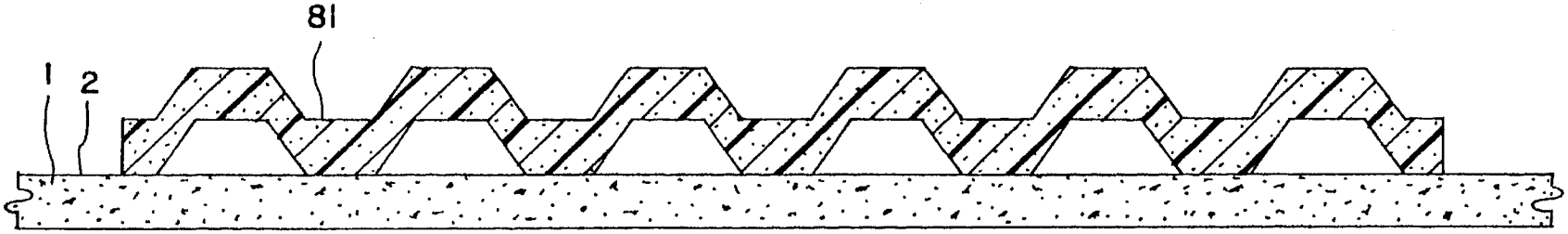
FIG. 3 shows a cross-sectional view showing the generally square wave configuration of a second embodiment of panel made in accordance with the teachings of the present invention.
Figure 4:
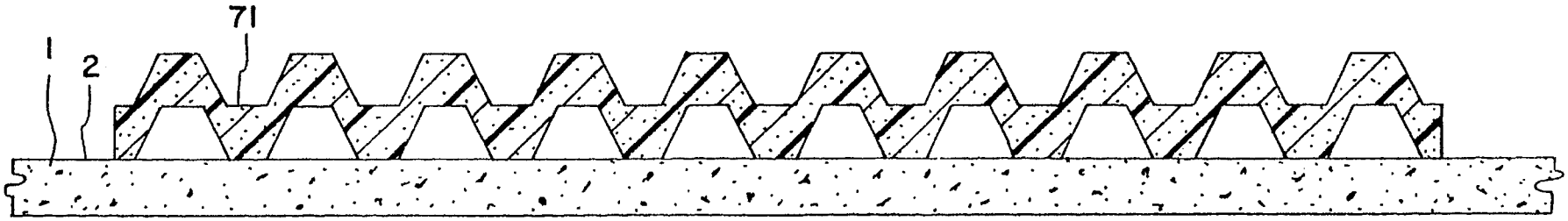
FIG. 4 shows a cross-sectional view showing the generally triangular wave configuration of a third embodiment of panel made in accordance with the teachings of the present invention.

In FIG. 2*b*, the wall 1 and wall surface 2 are shown. The surface 15 of the panel 11 is shown with the surface 13 shown in phantom. A valance 12 is seen mounted over the top end of panel 11 to seal the air chambers 18. A corresponding valance (not shown) is also mounted over the bottom of the panel 11. Of course, where a plurality of panels 11 are mounted adjacent one another, the adjacent panels engage one another to seal the chambers 18. The valances 12 are employed to seal edges of panels which allow open access to chambers 18. As seen in FIG. 2*b*, the valance 12 has a surface 16 shaped to correspond to the surface 15 of the panel 11. Of course, valances may similarly be employed with respect to all of the "one-dimensional" embodiments of the present invention as illustrated in FIGS. 2–14. In each embodiment, the valance is provided with a surface corresponding to the surface 16 of the valance 12 but shaped to correspond to the shape of the respective panel surface remote from the wall 1 surface 2. When utilizing valances, the rear air cavity needs to be sealed air-tight with adhesive. In this way, a pressure gradient is created when sound waves approach the boundary surface to which the foam is attached. To equalize the high pressure outside the foam, there is increased air flow into the ambient lower pressure variable depth air cavity and increased friction and consequently increased sound absorption. This effect occurs in the pressure zone where the particle velocity is low and the pressure is high.

Figure 6:
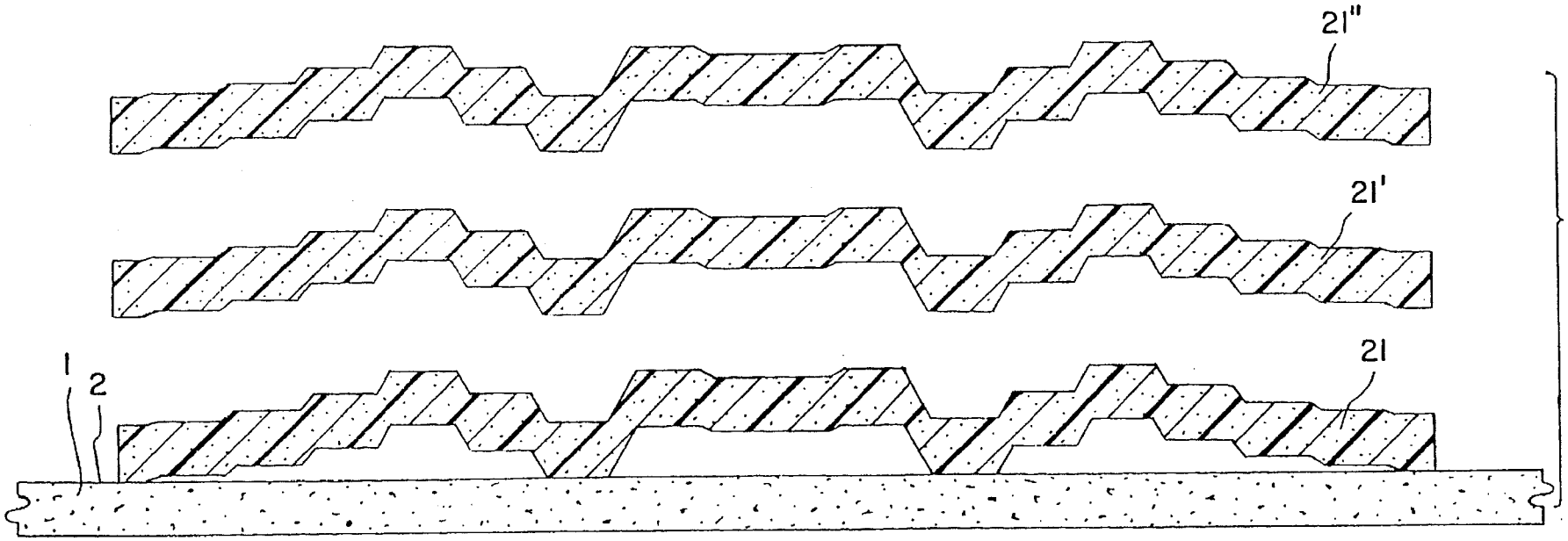
FIG. 6 shows an exploded cross-sectional view of a plurality of nestable foam panels designed in accordance with a number theoretic sequence.

FIGS. 1–14 all show the wall 1 and the flat surface 2. FIGS. 6–10 show various cross-sectional configurations of nestable foam panels. Thus, FIG. 6 shows a plurality of panels designated by the reference numerals 21, 21' and 21" each having the cross-sectional configuration which would be created through calculation of a number theory sequence.

Figure 7:
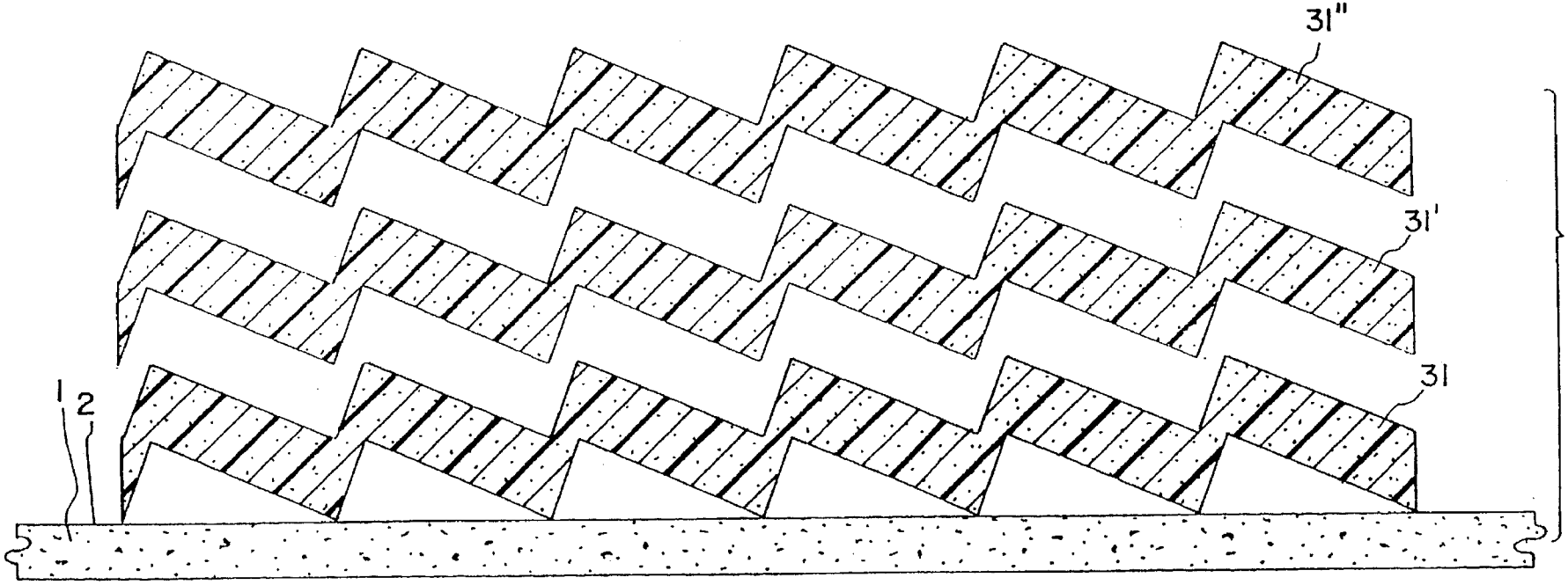
FIG. 7 shows a cross-sectional view showing a plurality of nestable foam panels with a saw tooth configuration in exploded view.

FIG. 7 shows a plurality of nestable foam panels designated by the respective reference numerals 31, 31' and 31" each of which has a saw tooth cross-sectional configuration.

Figure 8:
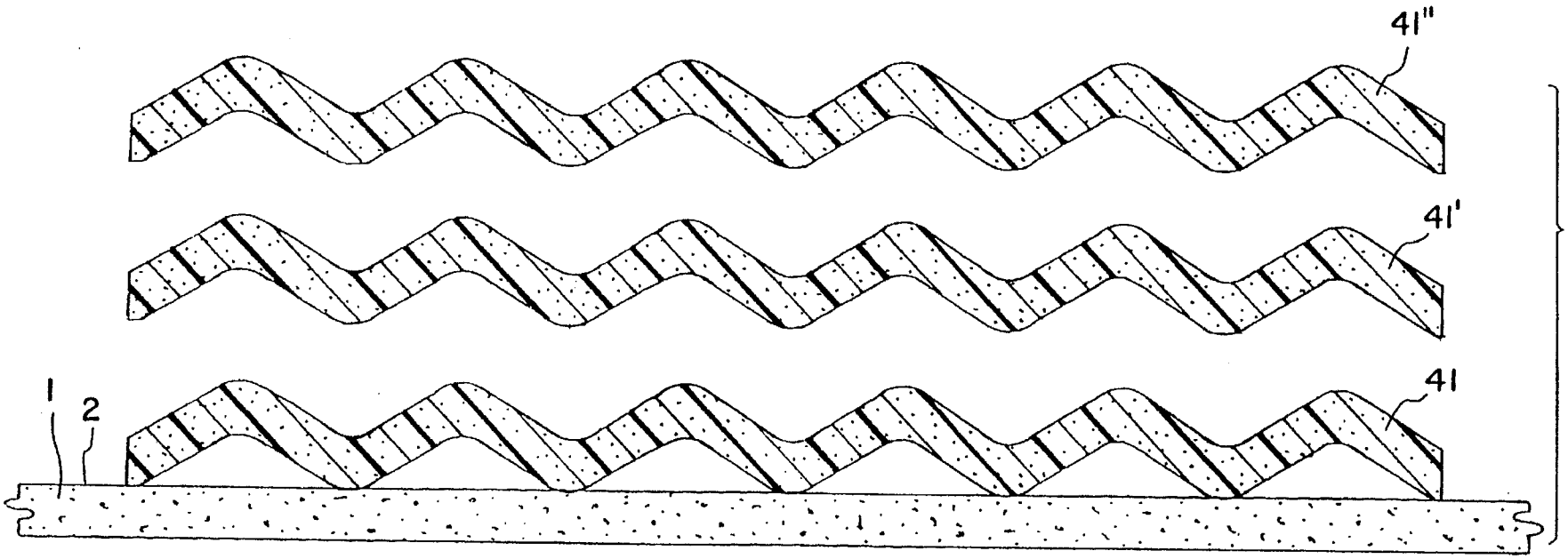
FIG. 8 shows an exploded cross-sectional view of a plurality of nestable foam panels having triangular wave configurations.

FIG. 8 shows a plurality of panels designated by the reference numerals 41, 41' and 41" each of which has a generally triangular sequential cross-section.

Figure 9:
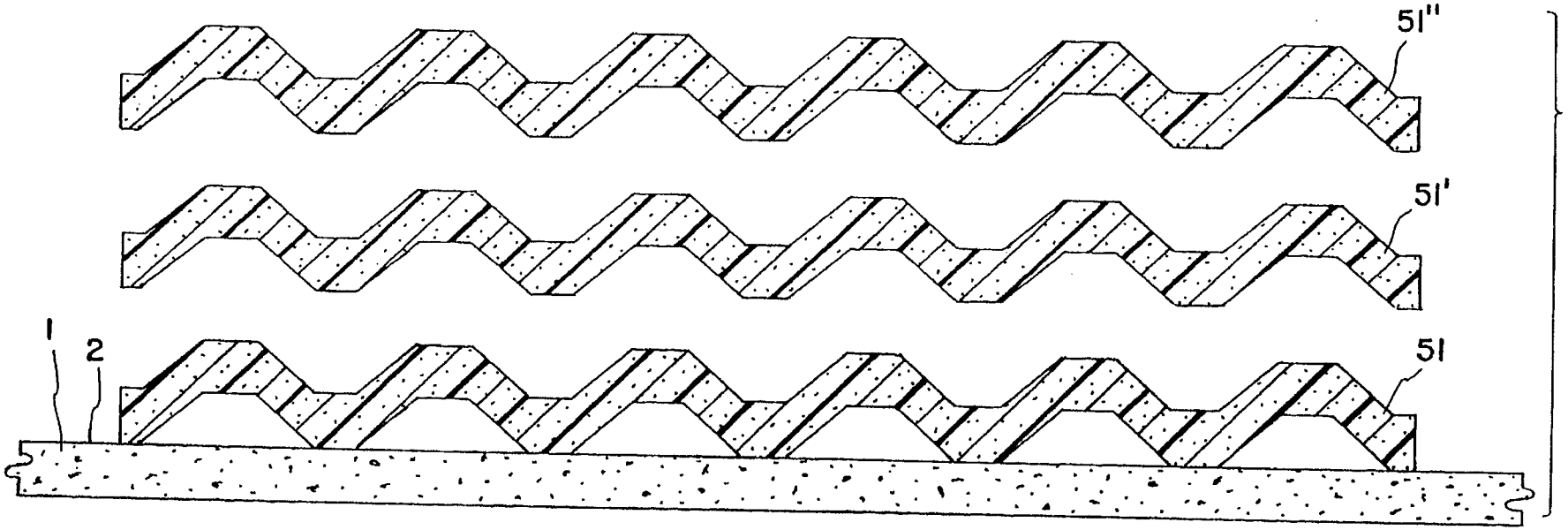
FIG. 9 shows an exploded cross-sectional view of a plurality of nestable foam panels having a generally crown-shaped triangular configuration similar to that of FIG. 4.

FIG. 9 shows a plurality of panels designated by the reference numerals 51, 51' and 51" each having a generally triangular but crown-shaped sequential cross-section.

Figure 10:
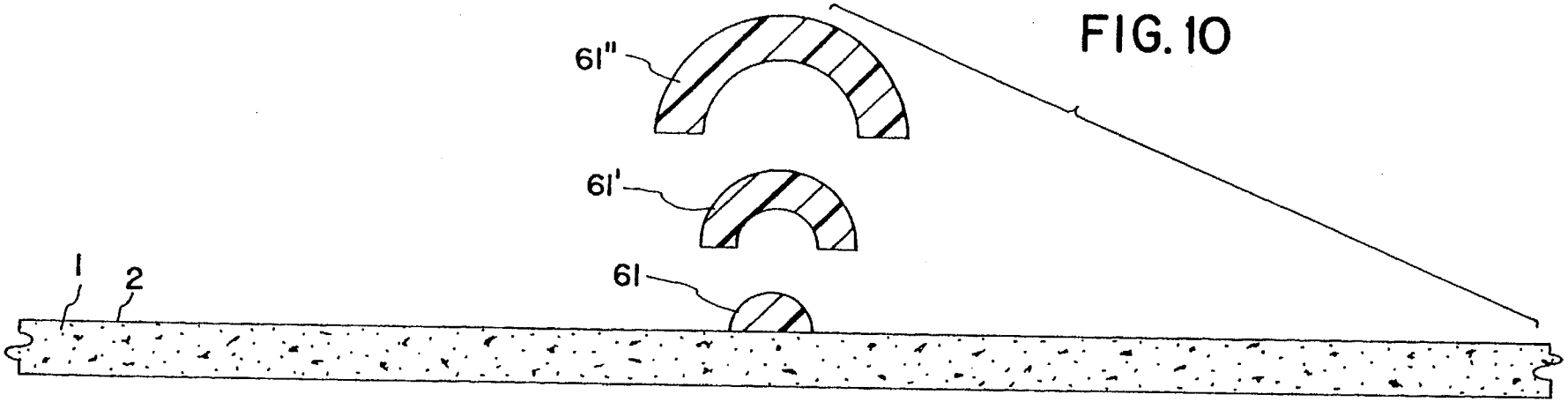
FIG. 10 shows an exploded cross-sectional view of a plurality of nestable foam panels each having a part cylindrical shape.
Figure 11:
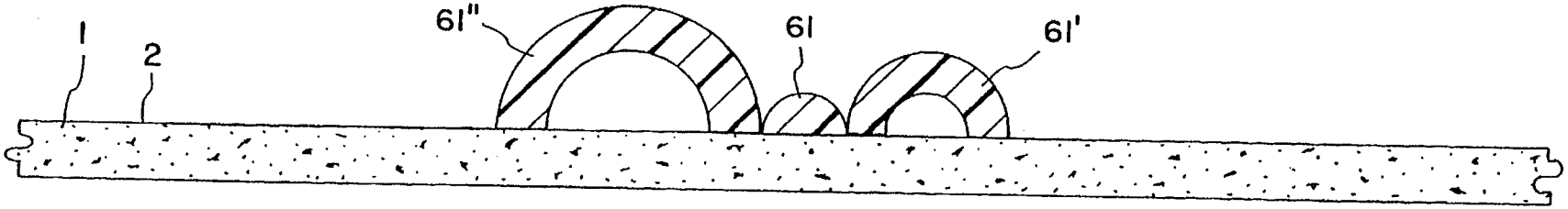
FIGS. 11, 12, 13 and 14 show further variations of the use of nestable part cylindrically shaped foam panels.
Figure 12:
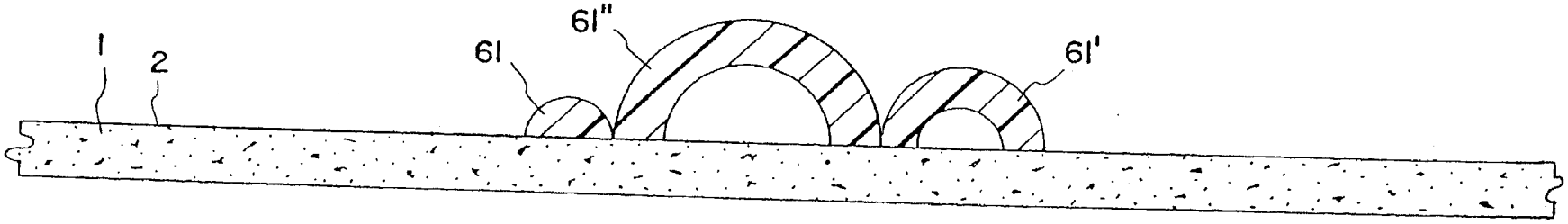
Figure 13:
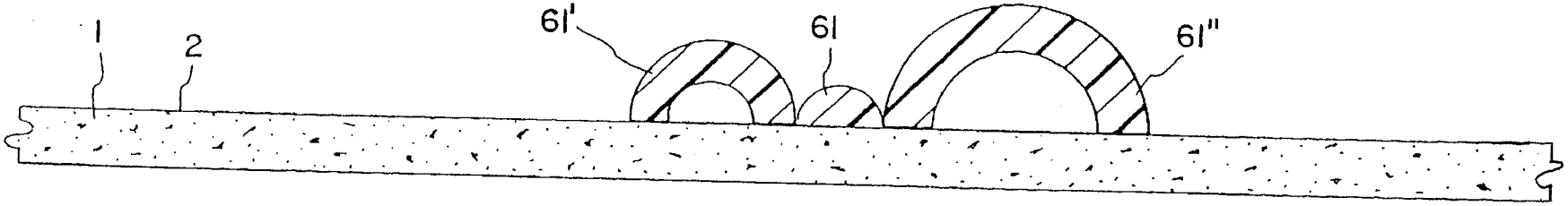
Figure 14:
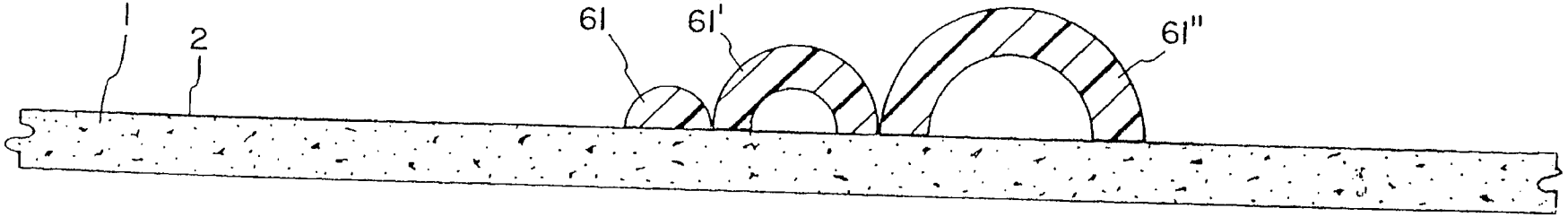

FIG. 10 shows a plurality of panels designated by the reference numerals 61, 61', 61" and 61'" which include part cylindrical cross-sections and are nestable within one another.

FIGS. 11–14 show cross-sectional views of panels such as the panels 61 et al. illustrated in FIG. 10 but mounted side-by-side in a lateral extended configuration.

Figure 15:
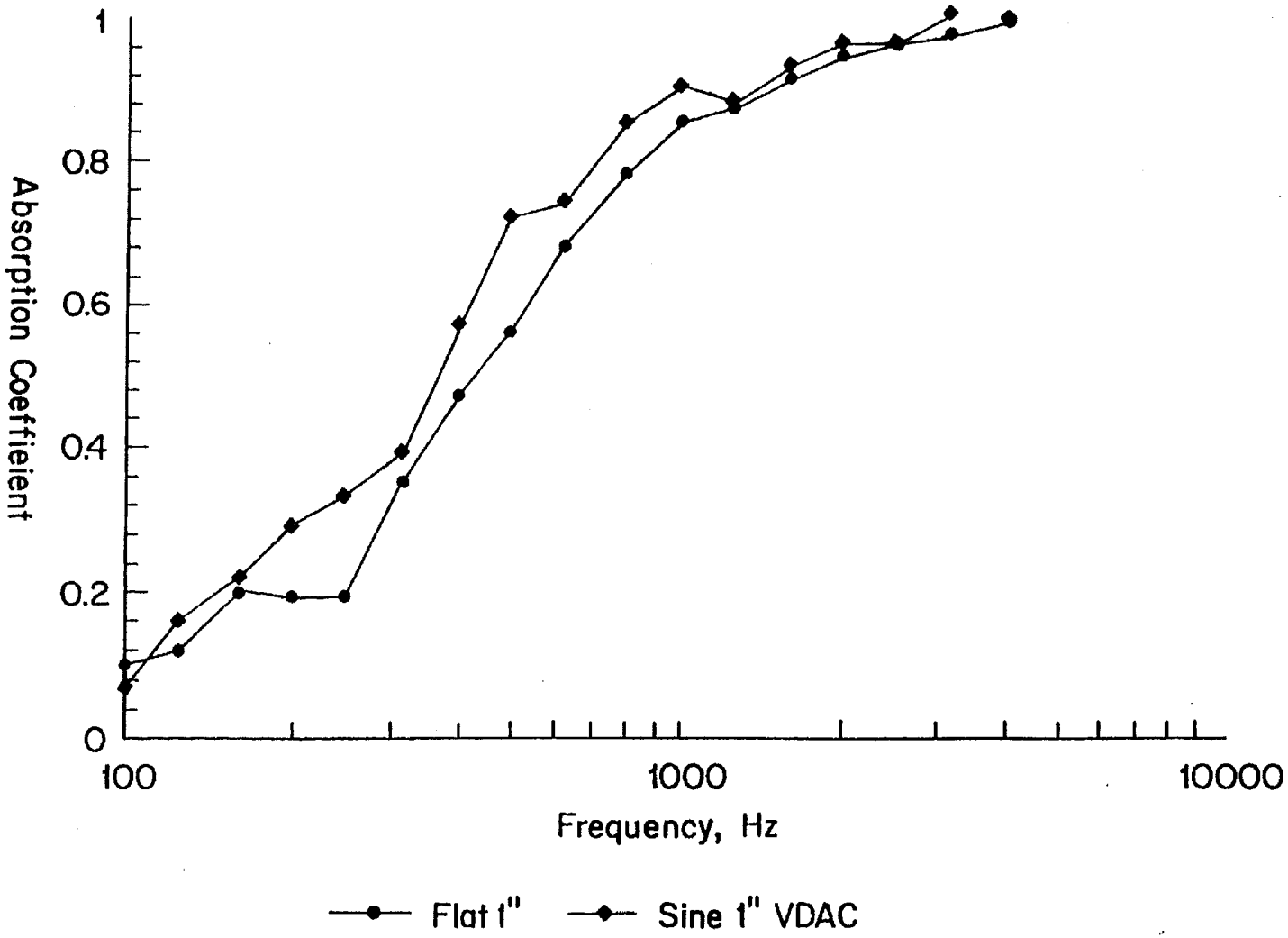
FIG. 15 shows a comparison of the absorption coefficient versus frequency for the panel illustrated in FIG. 1 and the panel illustrated in FIG. 2.
Figure 16:
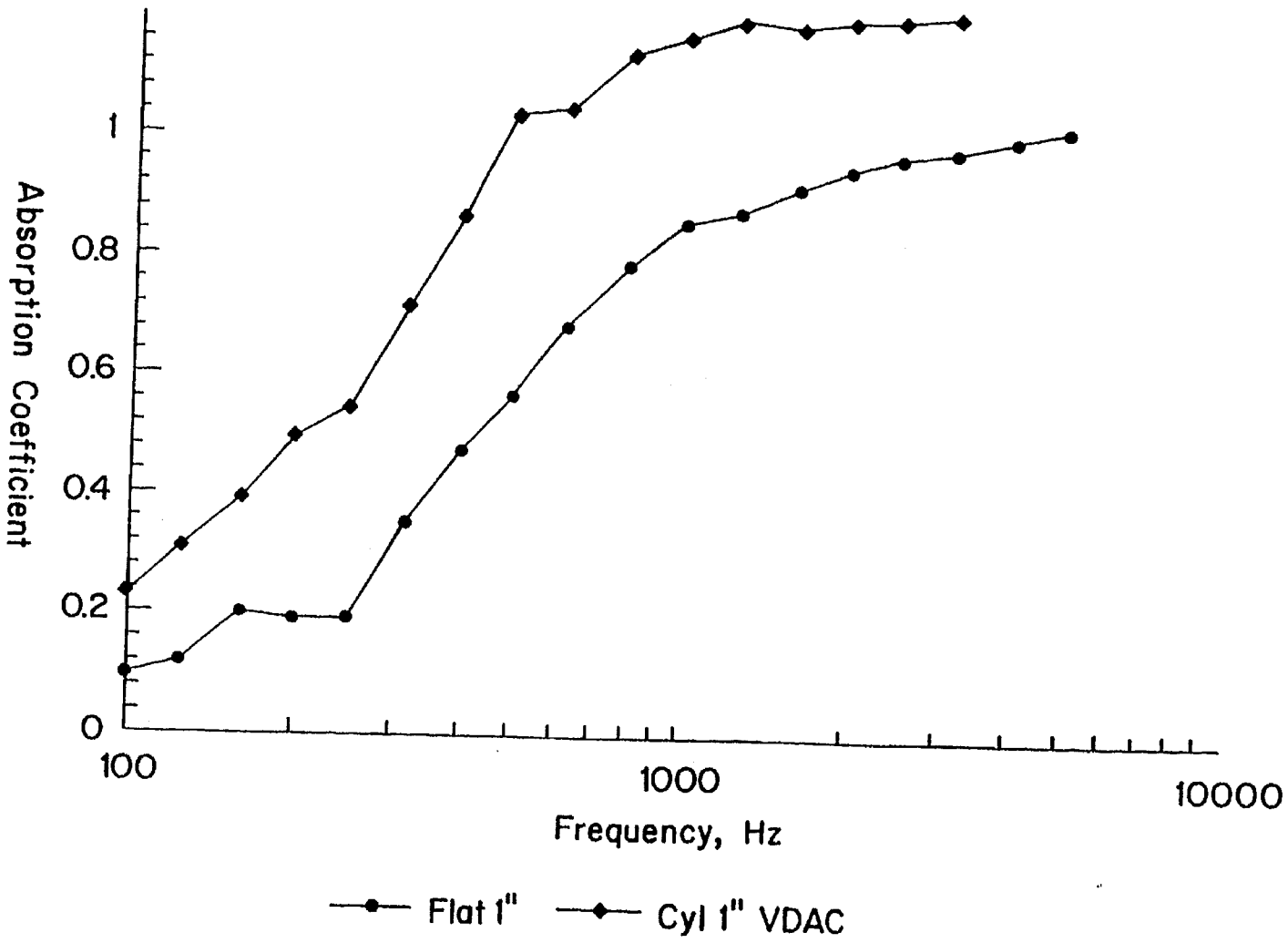
FIG. 16 shows a comparison of the absorption coefficient versus the frequency for the flat panel of FIG. 1 and the nesting cylinders illustrated in FIGS. 10–14.

FIG. 15 shows a cross-sectional view of a panel 71 which simulates a square-wave configuration. FIG. 16 shows a cross-sectional view of a panel 81 having a generally triangular cross-sectional wave pattern with the apices of the waves being flattened.

As should be understood, the variable depth rear air cavity which is created between each embodiment of the present invention and the surface 2 of the wall 1 maximizes sound absorption by positioning a significant portion of the foam away from the wall 2 where absorption would be at a mimimum. Furthermore, in each embodiment, the front surface facing the incident sound waves preferably has an increased surface area to improve the sound absorption characteristics on that side.

Furthermore, concerning each embodiment, the ability to nest additional layers of material gives the invention increased versatility. Additionally, when the material is nested in the manner contemplated herein, it takes up much less space than un-nestable materials would take up, thereby allowing storage in a smaller volume of space.

Figure 17:
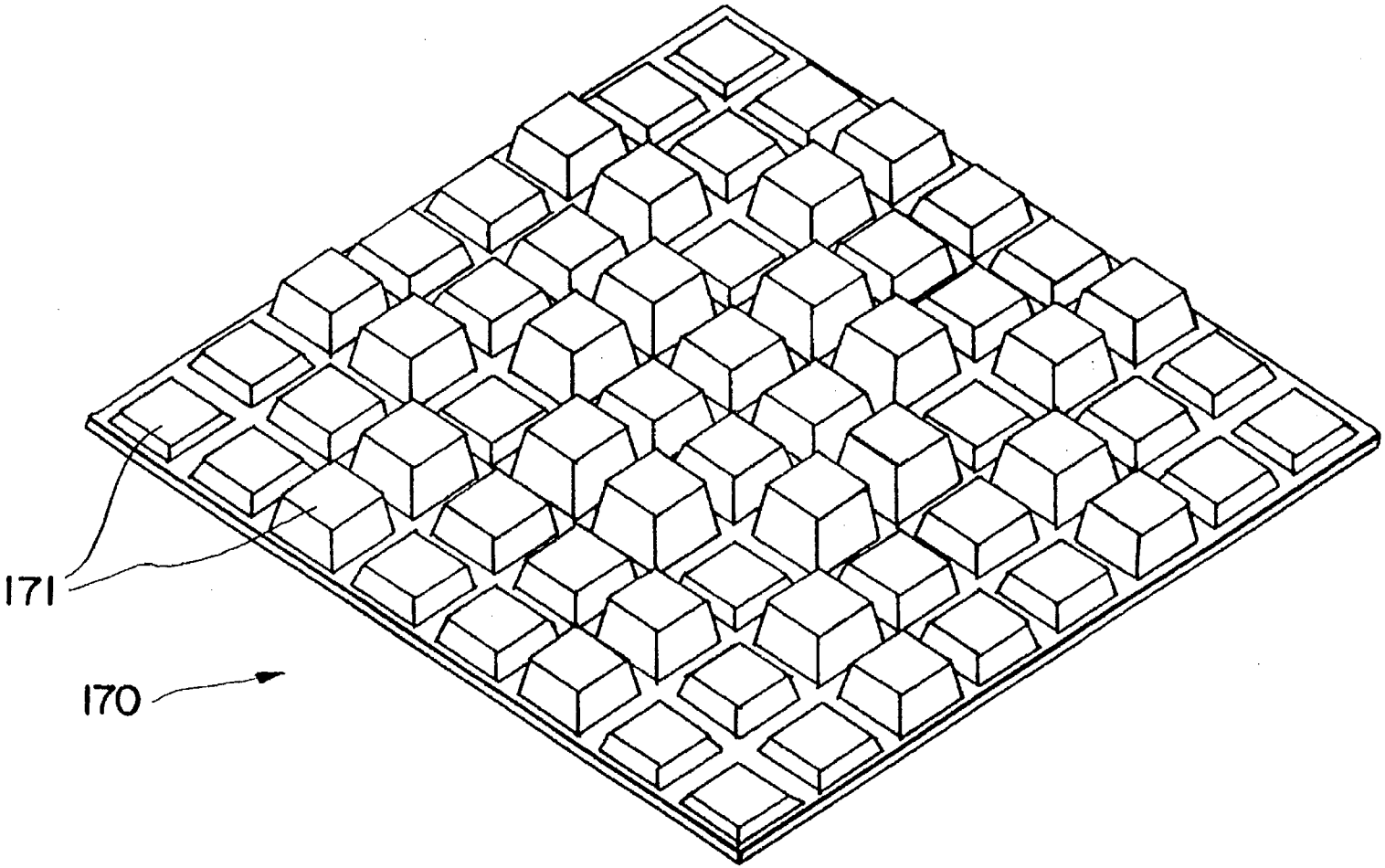
FIG. 17 shows a perspective view of a foam panel having a series of generally rectangular cubic protrusions extending outwardly therefrom.
Figure 18:
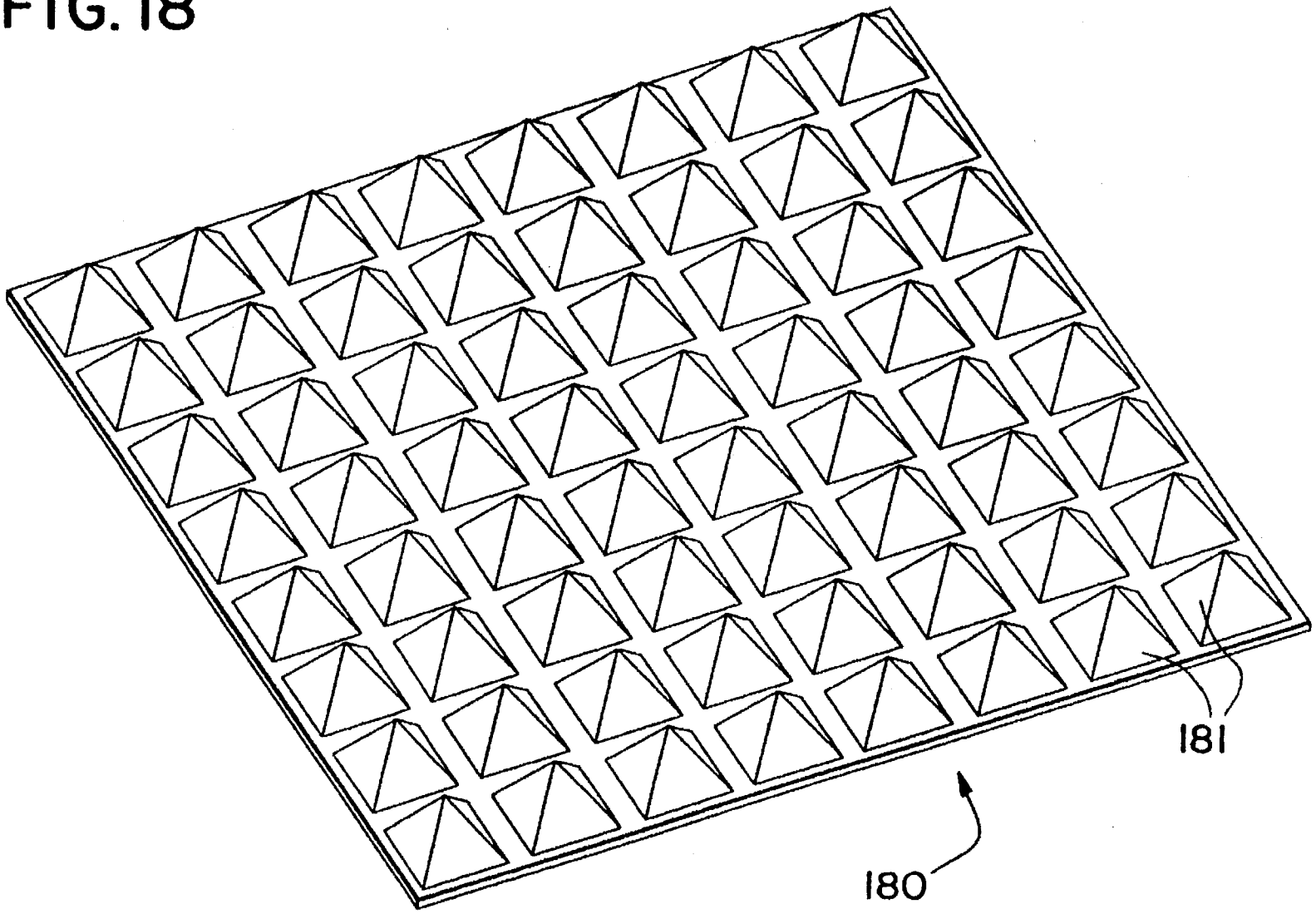
FIG. 18 shows a perspective view of a foam panel having a series of pyramidal protrusions extending outwardly therefrom.
Figure 19:
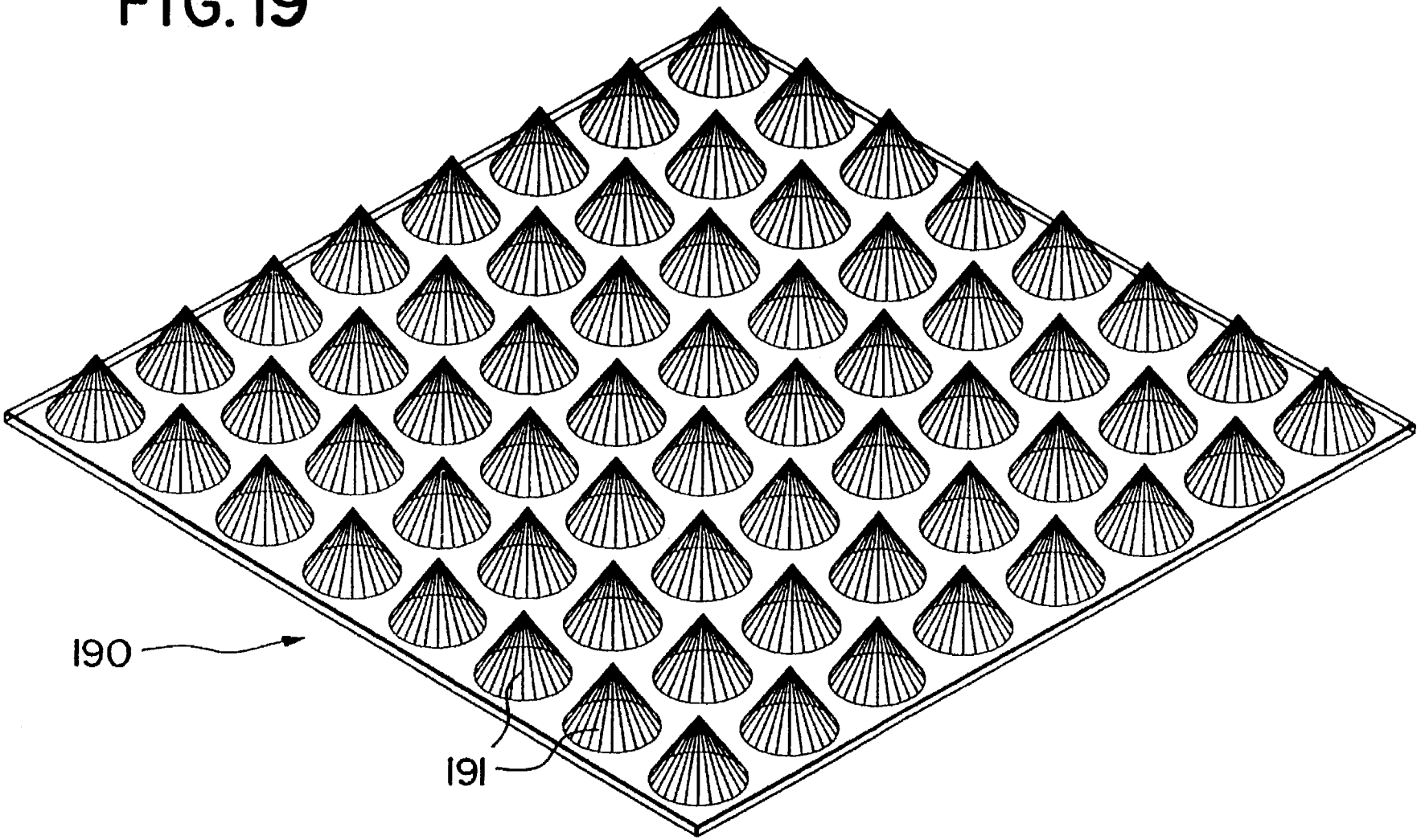
FIG. 19 shows a perspective view of a foam panel having a series of conical protrusions extending outwardly therefrom.
Figure 20:
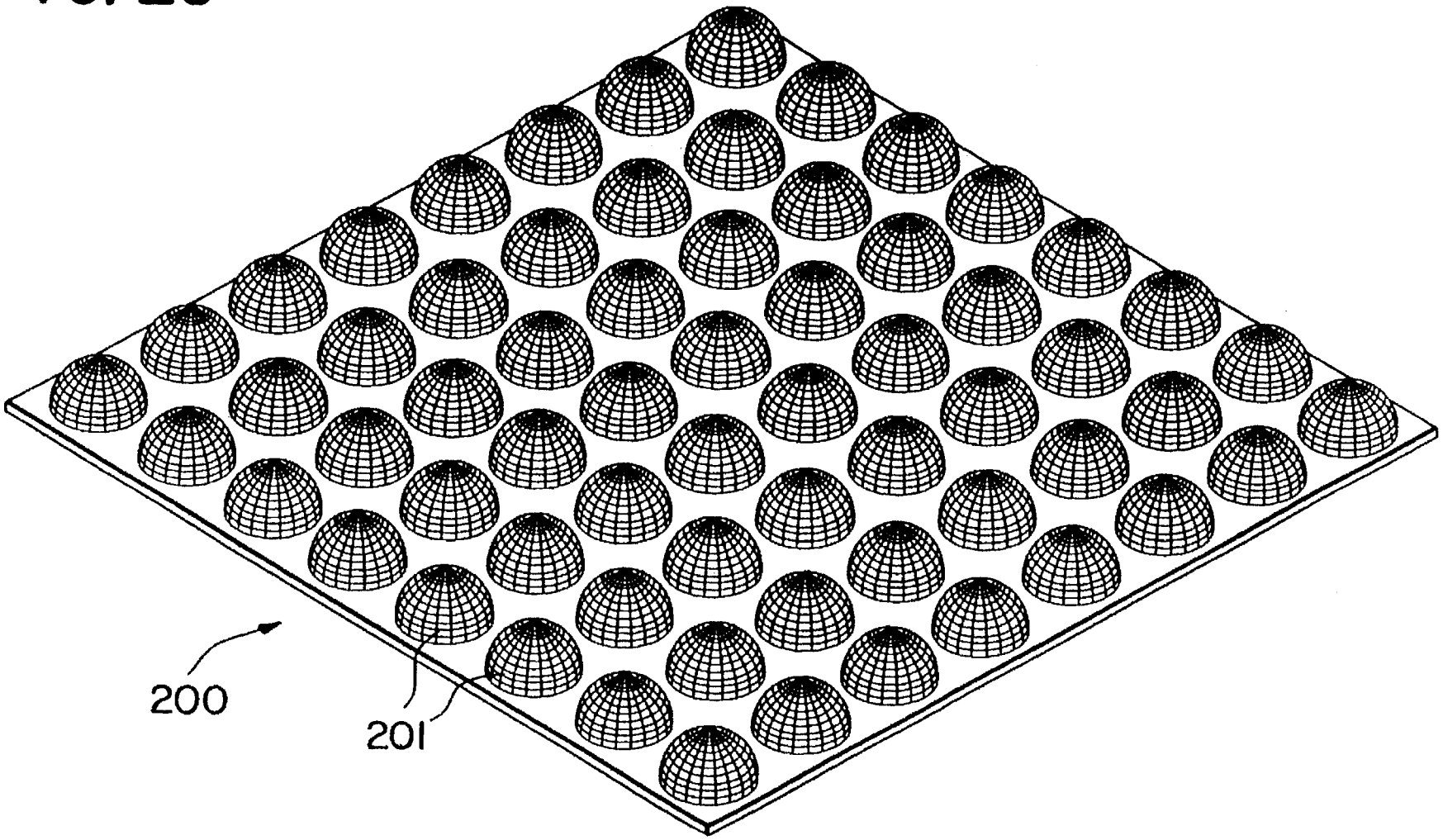
FIG. 20 shows a perspective view of a foam panel having a series of part-spherical protrusions extending outwardly therefrom.

FIGS. 17, 18, 19 and 20 show respective examples of panels having formed thereon, two-dimensional arrays of three-dimensional protrusions. FIG. 17 shows a panel 170 having a two-dimensional array of rectangular cubic shapes 171 of differing dimensions. FIG. 18 shows a panel 180 having a two-dimensional array of pyramidal protrusions 181. FIG. 19 shows a panel 190 having a two-dimensional array of conical protrusions 191. FIG. 20 shows a panel 200 having a two-dimensional array of part-spherical protrusions 201.

As is the case in the embodiments of FIGS. 2–14, in the preferred construction of the panels of the embodiments of FIGS. 17–20, the undersurfaces thereof (not shown) define a cavity shaped like the inverse of the top surface to (1) provide a chamber between the undersurface and adjacent wall surface, and (2) to permit stacking of plural panels as explained above.

In confirming the advantageous results which accrue through use of the present invention, Applicant engaged the services of the Hudson Valley Acoustics Laboratory to determine the noise reduction coefficient for various shaped acoustic materials. The materials tested consist of those which are illustrated in FIGS. 1, 2 and 10–14, respectively. In each case, the material which was tested consists of a white open-cell Class A melamine foam having a density of 0.6 lbs./ft.$^3$.

As explained above, FIGS. 15 and 16 display the absorption coefficients versus frequency for these three configurations of the foam material. In the Table below, the noise reduction coefficients for these materials are displayed as follows:

TABLE 1

| Configuration | Noise Reduction Coefficient |
|---|---|
| Flat Panel (FIG. 1) | 0.65 |
| Sine Wave Configuration Panel (FIG. 2) | 0.75 |
| Semi-Cylindrical Foam Half Tubes having Three Different Radii (FIGS. 10–14) | 0.98 |

As should be understood from Table 1, using the noise reduction coefficient for the flat panel as the base figure (0.65), the sine wave configuration reduces noise level by 15% over the flat panel and the cylindrical semi-tubes of differing radii reduce the noise level by 50% over the flat panel.

Accordingly, it should be understood that in accordance with the teachings of the present invention, a significant noticeable increase in sound absorption occurs when the present invention is employed.

If desired, a panel could be employed, in accordance with the teachings of the present invention, which only engages a wall surface at its peripheral edges. For example, a dome shaped or pyramid shaped panel could be employed.

As should be understood by those skilled in the art, when the embodiments of sound absorbing panels disclosed herein in accordance with the teachings of the present invention are attached to the associated wall surface 2 of the wall 1, adhesive need only be applied to those areas which directly engage the wall surface 2. Thus, the other areas of the rear surface of each embodiment are open and, due to their foamed, porous nature, allow passage of air particles thereby increasing the sound absorbing characteristics thereof as described hereinabove.

As explained above, with reference to FIG. **2*b*, the present invention also provides for the use of additional valances which are glued to the tops and bottoms of the one-dimensional embodiments for the purpose of sealing and creating an air-tight rear air cavity. These valances can be made of foam material or some hard material such as plastic laminate or wood. The valances follow the topology of the face of the foam material. In such cases, the perimeter of the air cavities must be glued air-tight with adhesive. In both one and two-dimensional designs, this is most easily accomplished by troweling a mastic on the wall surface to be covered and attaching the foam material. In this way, all foam sections which touch the mounting surface will be assured of being bonded to the surface. The sealed rear air cavity and method of attachment provides additional sound absorption in the low frequency range due to increased air flows from the high pressure exterior surface of the foam to the ambient lower pressure interior air cavity. The pressure gradient is created by sound waves impinging on the mounting surface. Near the mounting surface, the particle velocity is low and the pressure is high. Since the wavelength of low frequency sound is large, the foam material and mounting surface are in the high pressure zone at low frequencies. Thus, by sealing the variable depth air cavity, sound must pass through the intersticies of the foam to equalize the pressure imbalance caused by the sound, thus enhancing sound absorption. This increased low frequency absorption performance can be observed, for example, in the case of the semi-cylindrical foam tubes as demonstrated in the FIG. 16** graph.

Accordingly, an invention has been disclosed in terms of preferred embodiments thereof, which fulfill each and every one of the objects of the present invention as set forth hereinabove and provides a new and useful nestable sound absorbing foam with reduced area of attachment of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A sound absorbing panel for installation on a flat wall surface, comprising:

a) a sound absorbing panel defining an area of coverage over a wall surface and having a front surface and a rear surface, said rear surface including at least one area defining, along with a flat wall surface on which said panel is attached, a chamber comprising a variable depth air cavity with said at least one area spaced from said flat wall surface, said cavity enhancing sound absorption;

b) said rear surface having an attachment surface for attaching said panel to a wall surface, said attachment surface defining a small percentage of said area of coverage of said panel, said one area being relatively large in area as compared to an area of said attachment surface;

c) said front surface defining a surface configuration enhancing sound absorption;

d) said panel being made of a fire-resistant non-fibrous foam material having a Class A rating as defined by the 1991 National Fire Protection Association Life Safety Code Section 6-5.3.2.

2. The panel of claim 1, wherein said front surface and said rear surface have complimentary surface configurations whereby a plurality of panels are stacked upon one another to increase depth of sound absorbing material.

3. The panel of claim 1, wherein said rear surface has a cross-section resembling a sine wave.

4. The panel of claim 1, wherein said rear surface has a cross-section generally resembling a square wave.

5. The panel of claim 1, wherein said rear surface has a cross-section resembling a triangular wave.

6. The panel of claim 1, wherein said rear surface has a cross-section having upwardly and downwardly angled portions with flattened upper and lower extremities.

7. The panel of claim 1, wherein said rear surface has a cross-section resembling a pattern ascertained through calculation of a number theory sequence.

8. The panel of claim 1, wherein said rear surface has a cross-section resembling a saw tooth wave.

9. The panel of claim 1, wherein said rear surface has a cross-section comprising a part-cylinder.

10. The panel of claim 9, wherein said part-cylinder comprises a plurality of adjacent part-cylinders of diverse radii of curvature.

11. The panel of claim 1, wherein said front surface has a two-dimensional array of three-dimensional shapes thereon.

12. The panel of claim 11, wherein each of said shapes comprises a pyramid.

13. The panel of claim 11, wherein each of said shapes comprises a cone.

14. The panel of claim 11, wherein each of said shapes comprises a part-sphere.

15. The panel of claim 11, wherein each of said shapes comprises a rectangular cubic shape.

16. The panel of claim 1, wherein said attachment surface comprises less than 10% of said area of coverage, portions of said rear surface other than said attachment surface being spaced from said wall surface as far away as possible to improve sound absorption.

17. The panel of claim 1, wherein said front surface has a total surface area greater than said area of coverage.

18. The panel of claim 1, wherein said foam material comprises melamine.

* * * * *